United States Patent [19]

Hitz

[11] 4,334,397

[45] Jun. 15, 1982

[54] MASONRY STRUCTURE AND APPARATUS AND PROCESS FOR SPACING BLOCK IN THE STRUCTURE

[76] Inventor: George R. Hitz, 509 N. Cobb St., Milledgeville, Ga. 31061

[21] Appl. No.: 143,537

[22] Filed: Apr. 25, 1980

[51] Int. Cl.[3] ..... E04C 5/16

[52] U.S. Cl. ..... 52/687; 52/442; 52/562; 52/712

[58] Field of Search ..... 52/442, 603, 604, 438, 52/585, 677, 687, 712, 412, 413, 562, 749

[56] References Cited

U.S. PATENT DOCUMENTS

| | | | |
|---|---|---|---|
| 1,943,485 | 1/1934 | Osborne | 52/604 |
| 2,123,225 | 7/1938 | Barnhart | 52/421 |
| 2,325,653 | 8/1943 | Bingham | 52/421 |
| 2,483,560 | 10/1949 | Peterson | 52/604 |
| 2,543,716 | 2/1951 | Carini | 52/749 |
| 3,183,628 | 5/1965 | Smith | 57/442 |
| 3,641,731 | 2/1972 | Winfree | 52/105 |
| 4,091,587 | 5/1978 | Depka | 52/421 |
| 4,136,498 | 1/1979 | Kanigan | 52/438 |
| 4,190,999 | 3/1980 | Hampton | 52/687 |
| 4,229,922 | 10/1980 | Clark | 52/586 |

*Primary Examiner*—Reinaldo P. Machado

*Attorney, Agent, or Firm*—Newton, Hopkins & Ormsby

[57] ABSTRACT

A masonry wall is formed of a plurality of masonry blocks, i.e., bricks, with mortar, therebetween and in which spacing of the bricks from each other, both vertically and horizontally, is dictated by plastic spacer elements. The spacer element includes a plurality of connecting struts joined together in a common plane or in planes which are perpendicular to each other. Spacer fingers or protrusions protrude in opposite directions from the struts so as to contact the adjacent surfaces of the blocks and dictate the spacing of one block from the next, accordingly. The spacer elements remain embedded in the mortar.

24 Claims, 3 Drawing Figures

MASONRY STRUCTURE AND APPARATUS AND PROCESS FOR SPACING BLOCK IN THE STRUCTURE

BACKGROUND OF THE INVENTION

1. Field of the Invention

This invention relates to a masonry structure and an apparatus and process for spacing blocks in the structure and is more particularly concerned with a spacer element which in combination with conventional masonry blocks and mortar form a masonry wall.

2. Description of the Prior Art

In the past numerous devices have been suggested for aiding a person in building a wall and also in facilitating the spacing of the bricks or masonry blocks from each other. A search of the prior art revealed the following U.S. Pat. Nos.:

2,543,716—Carini
2,679,745—Bartram
3,030,738—Brewer et al.
3,411,257—Yaremchuk
3,641,731—Winfree
3,902,296—Thomas Of the above listed patents, the patent to *Winfree* U.S. Pat. No. 3,641,731 appears to be most significant in that in FIGS. 6–9 it reveals a stamped metal spacer employed for spacing the bricks apart sufficiently for mortar to be poured downwardly into the crevices between adjacent bricks. The *Winfree* procedure, however, requires retaining structures on opposite sides of bricks so as to arrest the outward flow of the mortar which is poured down through the space between bricks.

SUMMARY OF THE INVENTION

Briefly described, the present invention includes a spacer element which is employed for spacing one masonry block or brick from the next adjacent masonry block or brick. Such a spacer element is embedded in the soft mortar and has a frame from which spacer fingers project for engaging the opposed surfaces of adjacent bricks or masonry blocks in order to dictate the space between such surfaces. The spacer element is formed of plastic which is injection molded.

In one form of the invention, the spacer element includes rectangular frame formed of pairs of respectively parallel rods or struts, the ends of which are joined. Protruding from the corners of the frame in opposite directions are opposed pairs of spacer fingers or protrusions which are aligned with each other along an axis perpendicular to the frame. The frame has smaller dimensions than a conventional brick so as to be disposed between adjacent bricks and be wholly embedded in the mortar.

In another embodiment, a smaller U-shaped spacer frame or body formed of three struts, two struts of which are parallel to each other and are joined at their ends by the third strut. The spacer fingers or elements project along axes which are parallel to each other and perpendicular to the struts. Certain protrusions are at the corners of the U-shaped frame and others are spaced inwardly from the ends of the parallel struts.

In a third embodiment, the spacer element includes a right angularly disposed open body formed of parallel, horizontally disposed struts joined to parallel vertically disposed struts, the ends of the struts being joined by laterally extending parallel connector struts. A plurality of spacer fingers are carried by each of the struts and the fingers of each pair of fingers extend in opposite directions from each other along axes which are parallel to each other and perpendicular to the axes of the struts from which they extend.

Accordingly, it is an object of the present invention to provide an apparatus for producing a masonry structure, which apparatus will positively space one surface of a masonry block from the adjacent surface of another block, the apparatus being inexpensive to manufacture, durable in structure and efficient in operation.

Another object of the present invention is to provide a process of producing a masonry structure, which process can be carried out by a novice and produce a masonry structure in which the bricks or masonry blocks thereof are uniformly spaced from each other.

Another object of the present invention is to provide an apparatus for producing a masonry structure which apparatus is readily and easily inserted into soft mortar so as to space adjacent bricks from each other by a prescribed distance.

Another object of the present invention is to provide an apparatus for producing a masonry structure, which apparatus can be readily and easily produced by injection molding.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
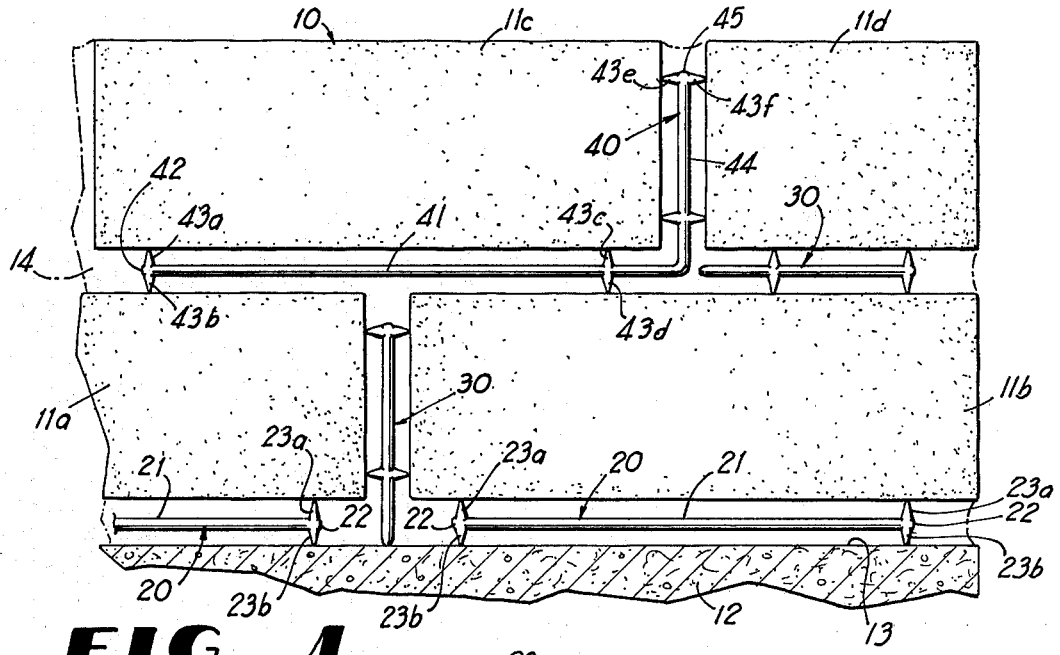
FIG. 1 is a fragmentary, partially broken away vertical, sectional view of a portion of a masonry structure using the spacer elements constructed in accordance with the present invention.

Referring now in detail to the embodiments chosen for the purpose of illustrating the present invention, numeral 10 in FIG. 1 denotes generally a masonry wall structure formed of a plurality of conventional masonry blocks or bricks 11*a*, 11*b*, 11*c* and 11*d*. The bricks 11*a* and 11*b* form a first row of a course of bricks which are mounted on a flat, horizontally disposed upper surface 13 of an appropriate foundation 12. As is customary, the foundation 13 is of a width approximately equal to or greater than the width of one of the bricks 11*a*, 11*b*, 11*c* or 11*d*.

It will be understood by those skilled in the art that a row of bricks, such as bricks 11*a* and 11*b*, form a first row over the foundation 12 and a row of bricks, such as bricks 13*c* and 13*d* form a second row over the first row, etc. Each of the bricks, as is conventional, is spaced apart from the next adjacent brick by a prescribed amount. Mortar or concrete in a wet plastic or pliable form is employed between the surfaces of the adjacent bricks together and solidifies to bind the bricks together.

According to the present invention, spacer elements are employed for dictating the spacing of the bricks apart, one form of the spacer element being denoted generally by the numeral 20, another form of the spacer element being denoted generally by the numeral 30 and still a third form of the spacer element being denoted generally by the numeral 40.

Figure 2:
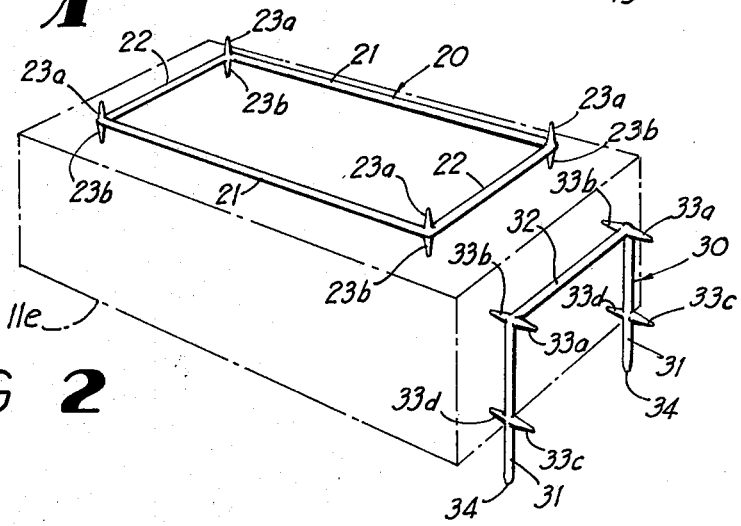
FIG. 2 is a prospective view of two different embodiments of the spacer element of the present invention and a brick shown in broken lines, the spacer elements being positioned appropriately adjacent to that brick.

As best seen in FIG. 2, the spacer element or apparatus 20 includes a flat, open, rectangular frame or base which is formed of a pair of longitudinally extending spaced, parallel, side struts 21, the ends of which are joined by spaced, parallel, straight, transversely extending opposed end rods 22, also of equal length. Each of the struts 21 and 22 is cylindrical in shape, being formed of plastic which is sufficiently rigid to maintain its shape and yet will flex, when necessary.

At the four corners of the frame formed by the struts or rods 21 and 22 are pairs of oppositely protruding, spacer fingers, protrusions or prongs 23*a* and 23*b*. Each finger 23*a* or 23*b* is a conical member, the proximal end of which is mounted integrally on the periphery of the struts 21 and 22. Each pair of adjacent fingers 23*a* and 23*b* is provided with a common axis which is perpendicular to the axis of the struts 21 and 22 and intersect with these strut axes at the corners of the frame. Preferably, each finger 23*a* or 23*b* is of approximately the same length and terminates in a rounded point or tip at its distal end. The distance between the points or tips of adjacent pairs of prongs 23*a*, 23*b* determines the spacing between one brick and the next adjacent brick or the surface 13 of the foundation 12, as the case may be. Usually this spacing is from about $\frac{1}{4}$ inch to $\frac{1}{2}$ inch and preferably about $\frac{3}{8}$ inch for conventional bricks; however, it may be varied, as desired.

All of the tips of the prongs or fingers 23*a*, terminate in a common plane parallel to the plane of the frame formed by the struts 21 and 22. Also, the tips of the prongs or fingers 23*b* terminate in a common plane which is parallel to the plane of the tips 23*a* and also parallel to the plane of the frame formed by the rods 21 and 22.

Preferably, if the spacer element 20 is to be employed with a conventional brick, the length of the frame, i.e., of struts 21 is approximately 6 inches and the width of the frame, i.e., the length of the struts 22 is approximately $2\frac{3}{4}$inches. A conventional brick is both longer and wider and, therefore, when the spacer element 20 is employed, it will be spaced inwardly of the facing surfaces of the brick, as seen in FIG. 2. The struts 21 and 22 are preferably cylindrical rods about $\frac{1}{8}$ inch in diameter.

When the spacer element 20 is to be employed, it is, for example, embedded in the soft motar 14 along the upper surface 13 of the foundation 12 so that one spacer element 20 receives one brick such as brick 11*a* or 11*b*, as the case may be. The spacer element 20 is inserted into the soft mortar 14 so as to be wholly embedded therein, being inwardly of the facing surfaces of the bricks, such as bricks 11*a* and 11*b*.

In like fashion, additional spacer elements 20 are mounted on top of the bricks which form the first row so as to provide spacer elements 20 for the second row, etc. Usually it is preferable to utilize a single spacer element 20 on a single brick, such as brick 11*e* in FIG. 2, the side struts 21 being spaced inwardly from the side faces of the brick 11*e* and the end struts 22 being spaced inwardly from the ends of the brick 22 so as to be centered on the brick.

Since the spacer fingers 23*a* and 23*b* will space the bricks of each row apart by the appropriate $\frac{3}{8}$'s inch or such other spacing as is desired, there is no need to delay installing subsequent rows of brick, one upon the other, since there is little or no danger of settling as when the weight of the brick causes the mortar to exude from between adjacent bricks.

As the bricks of a particular row are arranged end to end with appropriate mortar 14 disposed therebetween, the end spacer elements 30 are embedded in this end mortar. Each end spacer element 30 is formed of a U-shaped frame having straight, spaced, parallel side struts 31 one end of each of which is joined to the other end thereof by an end of the other strut 32. At the corners formed by a side strut 31 and an end strut 32 are the opposed pairs of oppositely protruding spacer prongs, fingers or protrusions 33*a* and 33*b* arranged in pairs along a common axis which is perpendicular to and intersects the axes of the struts 31 and 32 which form that corner. Additional fingers, such as fingers 33*c* and 33*d* are provided on the struts 31 intermediate the ends thereof. These spacer prongs or fingers 33*c* and 33*d* are arranged in pairs along axes which are perpendicular to the axis of the strut 31 and parallel to the axes of the prongs or fingers 33*a* and 33*b*, as illustrated in FIG. 2.

In use, the mortar 14 is inserted into a position between adjacent bricks, such as adjacent bricks 11*a* and 11*b*, and then the element 30 is inserted in a downward direction into the mortar. Additional motar may be filled in so as to enclose the spacer element 30. The bottom or outer ends 34 of the struts 31 rest upon the surface created by either the foundation or the row of bricks, the distance between the ends 34 and the pairs of prongs 33*c* and 33*d* being greater than $\frac{3}{8}$'s inch or greater than the distance between adjacent prongs 23*a* and 23*b* so that the prongs 33*c* and 33*d* are positioned for engagement by the ends of the bricks, such as bricks 11*a* and 11*b*.

It will be understood that in the event that a short brick, such as a half brick 11*d* is employed in the wall, this spacer element 30 may be employed in a horizontal position between the upper and lower faces of the bricks, such as the upper face of brick 11*b* and the lower face of brick 11*d* as seen in FIG. 1.

The open space between the ends 34 and between the struts 31 will facilitate the easy insertion of the spacer element 30 in place and also facilitate the appropriate positioning of the element 30 when the ends 34 come to rest on a flat surface, such as the surface 13 depicted in FIG. 1. Like the spacer element 20 the element 30 remains in place as the mortar hardens and will prevent the mortar from being extruded from between adjacent ends of the bricks. Since the spacer elements 20 and 30 are made of plastic, they are flexible and, even though they may have warped during the cooling of the plastic in the element, the plastic is sufficiently flexible that the weight or pressure of one brick will be sufficient to cause the struts 21, 22 or 31, 32, as the case may be, to become aligned and insure that each of the fingers is, therefore, disposed in engagement with its appropriate surface of a brick.

The third embodiment of the present invention, includes an apparatus or spacer element 40 which functions both as a spacer for the horizontal surface of a brick and as a spacer for the vertical end thereof. In more detail, this spacer element 40 includes a horizontal base or frame formed of a pair of longitudinally extending spaced, parallel, straight rods or struts 41, the ends of which are joined by a straight, transverse connector rod or strut 42. At the corners formed by the rods 41 and 42 are pairs of opposed vertical prongs or fingers 43*a* and 43*b* which are identical to the prongs 23*a* and 23*b*. In like fashion, the rods 41, intermediate their ends, are provided with opposed pairs of prongs 43*c* and 43*d* which are the same lengths as the prongs 43*a* and 43*b*. Thus, these four prongs space the bricks, such as brick 11*c* vertically, the tips of the prongs 43*a* and 43*c* engaging the bottom surface of brick 11*c* and the lower ends of the prongs or fingers 43*b* and 43*d* engaging the upper surfaces, such as bricks 11*a* and 11*b* as shown in FIG. 1.

It will be understood that the ends of the rods 41 protrude beyond the end of the brick 11*c* which it cradles and is provided with a pair of upstanding rods or struts of a vertical frame 44. The upper ends of the rods are connected by a horizontally disposed connector end rod or struts 45. The rods 44 are substantially identical in length to the rods 31 and the rod 45 is identical to rod 32. At the corners formed by the rods 44 and 45 are the opposed prongs or fingers 43*e* and 43*f* with axes perpendicular to the axes of rods 44 and 45.

Figure 3:
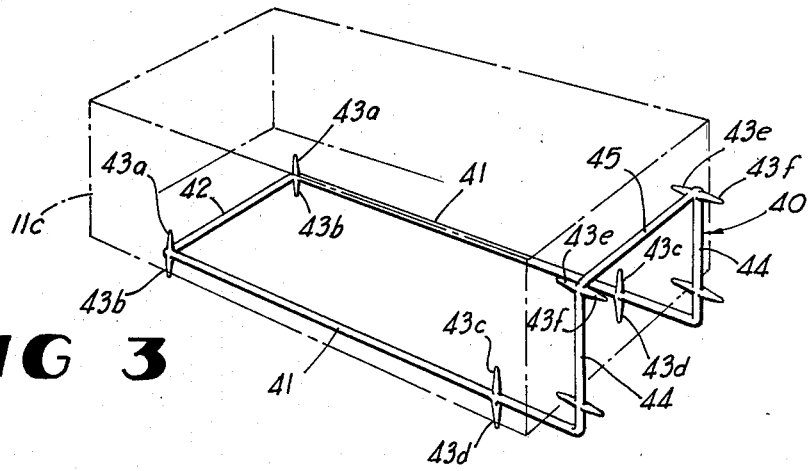
FIG. 3 is a view similar to FIG. 2 but still showing a third modified form of the present invention.

The advantage of the structure depicted in FIG. 3, namely, the spacer element 40 includes the fact that the first frame formed by the rods 41 and 42 is longer than the second frame and is open at its end and, therefore, can be inserted quite readily into the mortar by being moved angularly into the mortar which has been laid along both the horizontal surface and the vertical surface. Thus, brick 11*c* is spaced both from the bricks 11*a* and 11*b* as well as from the brick 11*d*, the first frame being shorter than the length of the brick and the second frame shorter than the first frame and shorter than the height of the back.

Usually the bricks are laid successively in rows with the pliable mortar being applied to a surface or surfaces of either the brick to be laid or the surface against which the brick will be placed. The appropriate spacer elements 20, 30 or 40 are then inserted into the pliable mortar prior to installation of the brick it spaces.

It will be obvious to those skilled in the art that many variations may be made in the embodiment here chosen for the purpose of illustrating the present invention without departing from the scope thereof as defined by the appended claims.

I claim:

1. An apparatus, for spacing apart adjacent masonry blocks, comprising:

(a) a frame in a first plane, said frame being formed of spaced, longitudinal struts and a transverse strut joining said longitudinal struts and spacing them apart; and (b) a plurality of spaced spacer fingers extending in opposite directions from opposite sides of the struts, said spacer fingers on one side of said frame terminating with the outer ends in a substantially common second plane and said spacer fingers on the other side of said frame terminating with their outer ends in a common third plane, the thickness of said frame being substantially less than the distance between the spaced apart adjacent masonry blocks.

2. The apparatus defined in claim 1 wherein said second plane and said third plane are parallel to each other.

3. The apparatus defined in claim 2 wherein the space between said second plane and said third is between approximately $\frac{1}{4}$ inch and approximately $\frac{1}{2}$ inch.

4. The apparatus defined in claim 1 wherein said fingers are conical.

5. The apparatus defined in claim 4 wherein said outer ends of said fingers are rounded.

6. The apparatus defined in claim 1 wherein said frame and said fingers are integral and are formed of plastic.

7. The apparatus defined in claim 1 wherein said fingers extend along respective axes and wherein the axes of said fingers on one side are respectively aligned with said fingers on the other side thereof.

8. The apparatus defined in claim 1 wherein said transverse strut joins the ends of said longitudinal struts and said fingers extend in both directions from the junctions of the struts.

9. The apparatus defined in claim 1 wherein said fingers extend along respective axes and wherein the axes of adjacent fingers are aligned with each other.

10. The apparatus defined in claim 1 wherein said frame is formed of first parallel struts, and an end strut for joining the ends of said parallel struts to define a U-shaped frame disposed in said first plane, and including a second U-shaped frame formed of second parallel struts, and an end strut extending between the ends of said parallel strut, the other ends of said second parallel struts being joined to the struts of said first parallel struts, said second frame being in a plane substantially perpendicular to the said first plane and additional fingers extending from both sides of said second frame.

11. The apparatus defined in claim 10 wherein said fingers are conical and have rounded ends and wherein the fingers which extend from said second frame terminate in planes which are parallel to and spaced on opposite sides of said second frame.

12. The apparatus defined in claim 11 wherein said second frame is shorted than said first frame, the length of said first frame being less than the length of a conventional brick and the length of said second frame being less than the height of a conventional brick.

13. An apparatus, for spacing apart masonry blocks, comprising:

(a) an open frame in a first plane; and (b) a plurality of spacer fingers extending in opposite directions from opposite sides of said frame, said spacer fingers on one side of said frame terminating with the outer ends in a substantially common second plane and said spacer fingers on the other side of said frame terminating with their outer ends in a common third plane;

(c) said frame being formed of straight, flexible, parallel side struts and straight, flexible, parallel end struts, the side struts and end struts being joined to form an open rectangle, the dimensions of which are less than the dimensions of a conventional brick.

14. The apparatus defined in claim 13 wherein said fingers extend from the corners formed by said struts and wherein the axes of the fingers on one side of said frame are aligned with the axes of the fingers on the other side of said frame and wherein said frame is U-shaped.

15. The apparatus defined in claim 14 wherein said fingers are conical and have rounded ends and wherein said first plane and said second plane and said third plane are parallel to each other.

16. The apparatus defined in claim 15 wherein said second plane and said third plane are between approximately $\frac{1}{4}$ inch and $\frac{1}{2}$ inch apart.

17. A masonry wall structure comprising a plurality of blocks being spaced from each other and arranged in generally parallel rows and mortar within the space between adjacent blocks, the improvement comprising spacer elements between the adjacent surfaces of certain of said blocks and embedded in said mortar, said spacer elements each having a frame formed of flexible struts and fingers extending from opposite side of said struts, said fingers contacting said adjacent surfaces and preventing inward movement of the blocks of said surfaces toward each other.

18. The apparatus defined in claim 17 wherein each spacer element is an integral plastic member.

19. An apparatus, for spacing apart masonry blocks, comprising:

(a) an open frame in a first plane said frame being U-shaped; and (b) a plurality of spacer fingers extending from in opposite directions from opposite sides of said frame, said spacer fingers on one side of said frame terminating with the outer ends in a substantially common second plane and said spacer fingers on the other side of said frame terminating with their outer ends in a common third plane.

20. The apparatus defined in claim 19 wherein said outer ends of said fingers are rounded to minimize entrapment of said grains in the mortar between the fingers and the blocks.

21. The apparatus defined in claim 19 wherein said frame and said fingers are formed of plastic.

22. The apparatus defined in claim 19 wherein said fingers extend along respective axes and wherein the axes of said fingers on one side are respectively aligned with the axes of said fingers on the other side thereof for stability of said apparatus when a block is pressed in place and for resistance to compressive forces on said apparatus and for providing common axes of contact between adjacent bricks for reducing the probability of incorporating the inherent irregularaties of the bricks into the structure.

23. The apparatus defined in claim 19 wherein said frame comprises a plurality of struts, the ends of which are joined and said fingers extend in both directions from the junctions of said struts for stability of said apparatus when blocks are pressed in place.

24. The apparatus defined in claim 19 including a transverse strut joining the ends of the U-shaped frame.

* * * * *